US010260215B2

(12) United States Patent
Chen et al.

(10) Patent No.: US 10,260,215 B2
(45) Date of Patent: Apr. 16, 2019

(54) FAUCET WITH A ROTATABLE OUTLET STRUCTURE

(71) Applicants: Jui-Chien Chen, Lugang Township, Changhua County (TW); Jui-Ching Chen, Lugang Township, Changhua County (TW)

(72) Inventors: Jui-Chien Chen, Lugang Township, Changhua County (TW); Jui-Ching Chen, Lugang Township, Changhua County (TW)

( * ) Notice: Subject to any disclaimer, the term of this patent is extended or adjusted under 35 U.S.C. 154(b) by 0 days.

(21) Appl. No.: 15/680,861

(22) Filed: Aug. 18, 2017

(65) Prior Publication Data

US 2019/0055719 A1 Feb. 21, 2019

(51) Int. Cl.
*E03C 1/04* (2006.01)

(52) U.S. Cl.
CPC .... *E03C 1/0404* (2013.01); *E03C 2001/0414* (2013.01); *Y10T 137/8807* (2015.04)

(58) Field of Classification Search
CPC ..... E03C 1/04; E03C 1/0401; E03C 1/0402; E03C 1/0403; E03C 1/0404; E03C 2001/0414; Y10T 137/9464; Y10T 137/8807
USPC ..... 4/675–678
See application file for complete search history.

(56) References Cited

U.S. PATENT DOCUMENTS

| | | | | | |
|---|---|---|---|---|---|
| 4,592,388 | A * | 6/1986 | Wilcox | F16L 37/008 | 137/615 |
| 6,941,971 | B1 * | 9/2005 | Hsien | E03C 1/0404 | 137/801 |
| 7,537,025 | B2 * | 5/2009 | Kuna | E03C 1/0404 | 137/616.5 |
| 8,061,386 | B2 * | 11/2011 | Mueller | E03C 1/0404 | 137/801 |
| 8,186,375 | B2 * | 5/2012 | Andersen | E03C 1/0404 | 137/359 |
| 8,430,345 | B2 * | 4/2013 | Esche | E03C 1/0404 | 137/801 |
| 9,637,892 | B2 * | 5/2017 | Lee | E03C 1/04 | |
| 10,066,375 | B2 * | 9/2018 | Kostorz | E03C 1/0403 | |
| 2012/0067437 | A1 * | 3/2012 | Xia | E03C 1/0404 | 137/317 |
| 2014/0015243 | A1 * | 1/2014 | King | E03C 1/021 | 285/8 |

* cited by examiner

*Primary Examiner* — Reinaldo Sanchez-Medina
*Assistant Examiner* — David Colon-Morales
(74) *Attorney, Agent, or Firm* — Egbert, McDaniel & Swartz, PLLC

(57) ABSTRACT

A faucet with a rotatable outlet structure includes a main body, a valve assembly disposed in the main body, a connecting structure rotatably received in the main body, an outlet structure rotatably mounted onto the main body and a control lever connected to the valve assembly, wherein the outlet structure includes an outer tube and an inner tube received in the outer tube. The outer tube is engaged to the connecting structure and the inner tube is securely sleeved on the connecting structure. Consequently, the inner tube is rotated with the outer tube when the outer tube is rotated relative to the main body such that inner tube does not need to be twisted when the outer tube is rotated relative to the main body.

5 Claims, 6 Drawing Sheets

FAUCET WITH A ROTATABLE OUTLET STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a faucet, and more particularly to a faucet with a rotatable outlet structure.

2. Description of Related Art Including Information Disclosed Under 37 CFR 1.97 and 37 CFR 1.98

Faucets are provided to control the outlet flow path of running water. In the kitchen, the conventional faucet usually is a gooseneck faucet for providing a greater operating space. In addition, for easily cleaning the objects in the sink, the outlet structure of the gooseneck faucet is rotatable relative to a main body thereof.

The outlet structure of the conventional gooseneck faucet includes an outer tube rotatably mounted onto the main body and a flexible inner tube disposed in the outer tube. However, the inner tube may be twisted when the outer tube is overly rotated relative to the main body. As a result, the rotating angle of the outer tube in limited. The caliber of the twisted inner tube is smaller than that of the original inner tube such that the water encounters difficulty flowing through the inner tube and the water pressure in the inner tube is raised. The high pressure water may cause leaking of the faucet.

The present invention has arisen to mitigate and/or obviate the disadvantages of the conventional (gooseneck) faucet.

BRIEF SUMMARY OF THE INVENTION

The main objective of the present invention is to provide an improved faucet that has a rotatable outlet structure disposed thereon.

To achieve the objective, the faucet with a rotatable outlet structure in accordance with the present invention comprises a main body adapted to be mounted on a worktable and having an outlet flow passage defined therein. A valve assembly is mounted in the main body and adapted to be connected to a water source. A tubular connecting structure is rotatably mounted in the main body. The connecting structure is divided into a first insertion and a second insertion, wherein the first insertion is water-tightly and rotatably inserted into the outlet flow passage. The connecting structure is formed with a first coupling between the first insertion and the second insertion. An outlet structure is rotatable mounted onto the main body. The outlet structure includes an outer tube having a lower end rotatably received in the main body and an inner tube received in the outer tube, wherein the inner tube is flexible and water-tightly and securely sleeved on the second insertion. A second coupling is formed on a lower end of the outer tube and engaged to the first coupling such that the connecting structure does not be rotated relative to the outer tube. A control lever is connected to the valve assembly, wherein the control lever is provided to operate the valve assembly for selectively communicating the outlet flow passage with the water source such that the water flows through the outer tube and/or the inner tube via the valve assembly.

Further benefits and advantages of the present invention will become apparent after a careful reading of the detailed description with appropriate reference to the accompanying drawings.

DETAILED DESCRIPTION OF THE INVENTION

Figure 1:
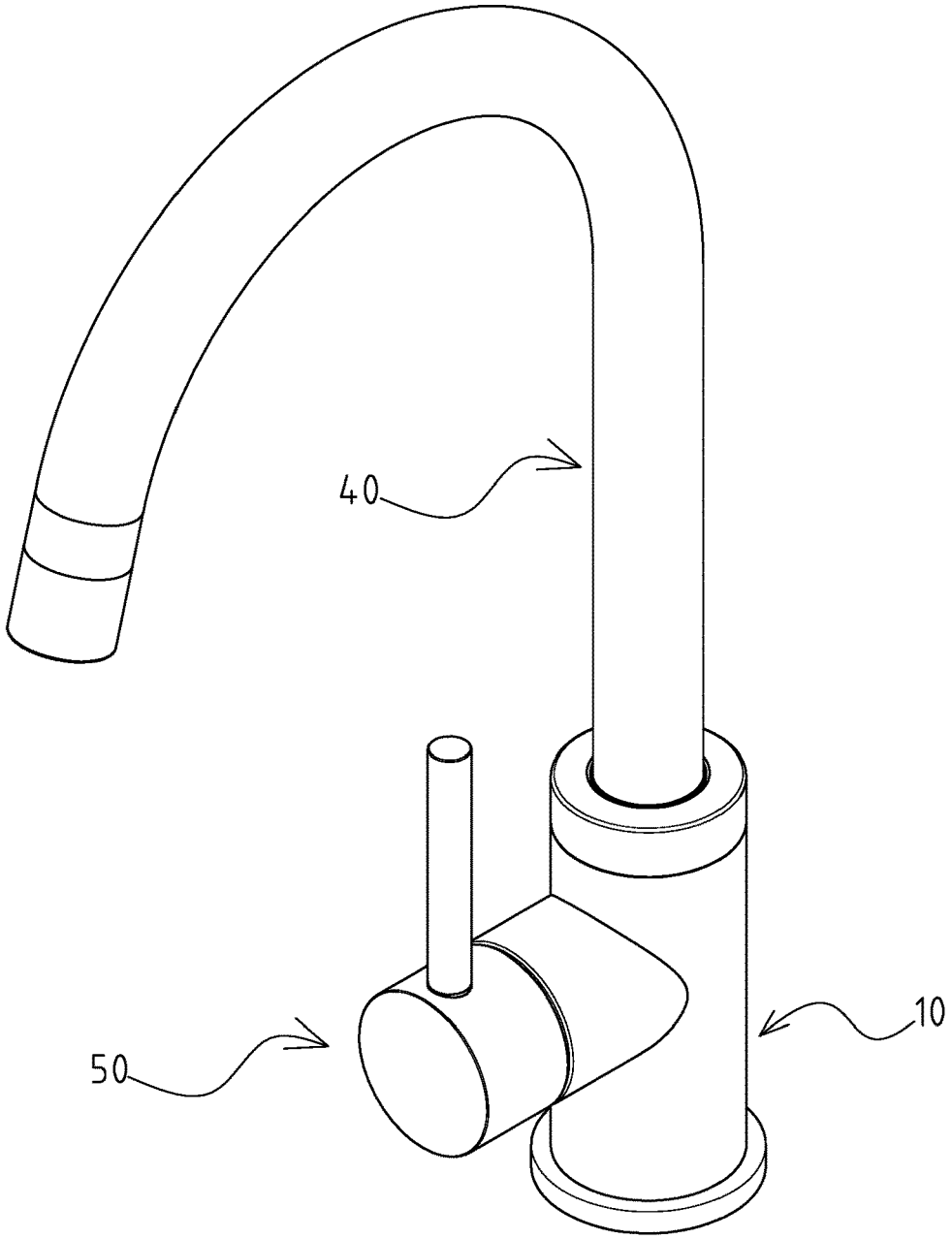
FIG. 1 is a perspective view of a faucet with a rotatable outlet structure in accordance with the present invention.
Figure 2:
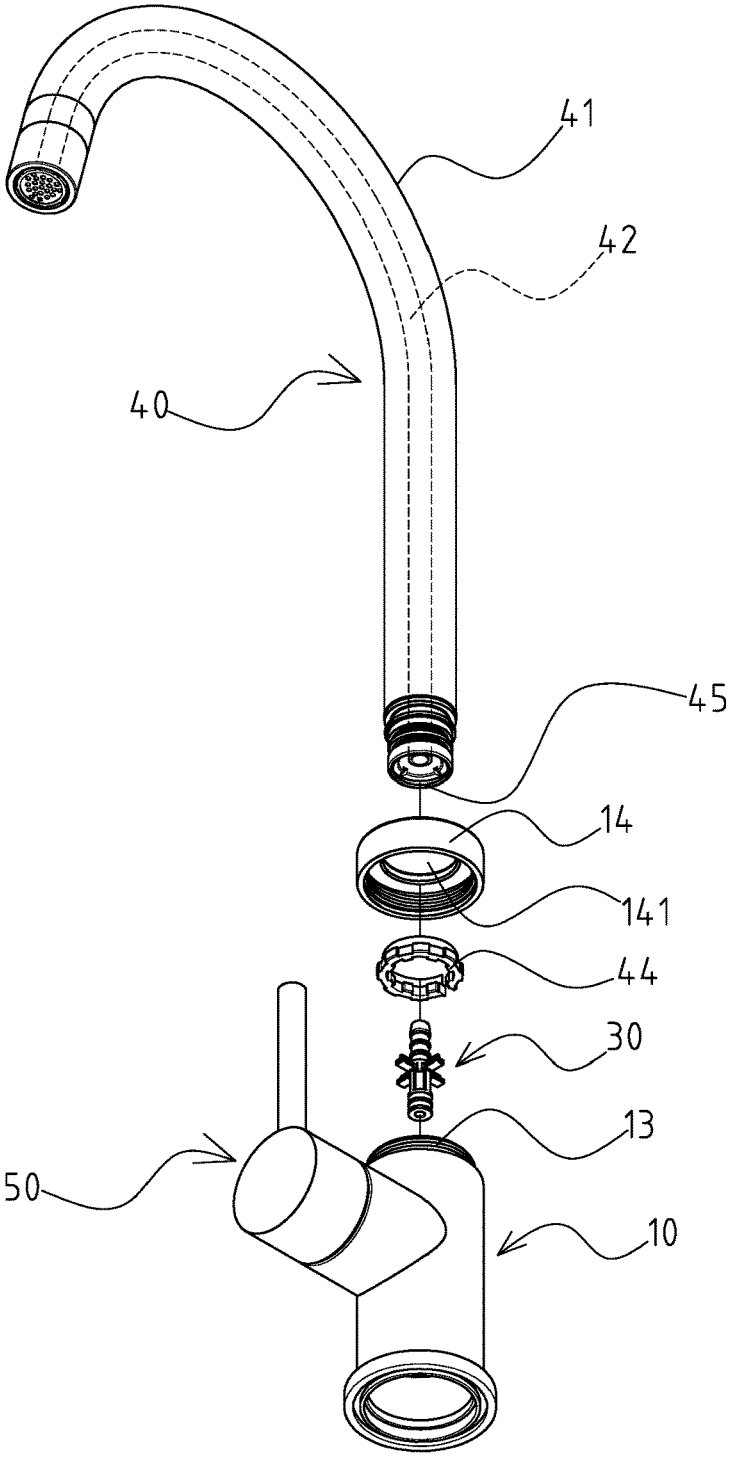
FIG. 2 is an exploded perspective view of the faucet in FIG. 1.

Referring to the drawings and initially to FIGS. 1-4, a faucet with a rotatable outlet structure in accordance with the present invention comprises a main body 10, a valve assembly 20 mounted in the main body 10, a connecting structure 30 rotatably mounted in the main body 10, an outlet structure 40 rotatable mounted onto the main body 10 and a control lever 50 connected to the valve assembly 20. The main body 10 is adapted to be mounted on a worktable, such as a kitchen counter (not shown), and has an outlet flow passage 11 defined therein. The valve assembly 20 is adapted to be connected to a water source. The connecting structure 30 is tubular, and divided into a first insertion 31 and a second insertion 32, wherein the first insertion 31 is water-tightly and rotatably inserted into the outlet flow passage 11. The connecting structure 30 is formed with a first coupler 33 between the first insertion 31 and the second insertion 32. The outlet structure 40 has a lower portion is water-tightly and rotatably received in the main body 10. The outlet structure 40 includes an outer tube 41 having a lower end rotatably received in the main body 10 and an inner tube 42 received in the outer tube 41, wherein the inner tube 42 is flexible and water-tightly and securely sleeved on the second insertion 32. A second coupler 43 is formed on a lower end of the outer tube 41 and engaged to the first coupler 33 such that the connecting structure 30 does not be rotated relative to the outer tube 41. The control lever 50 is provided to operate the valve assembly 20 for selectively communicating the outlet flow passage 11 with the water source such that the water flows through the outer tube 41 and/or the inner tube 42 via the valve assembly 20.

Figure 3:
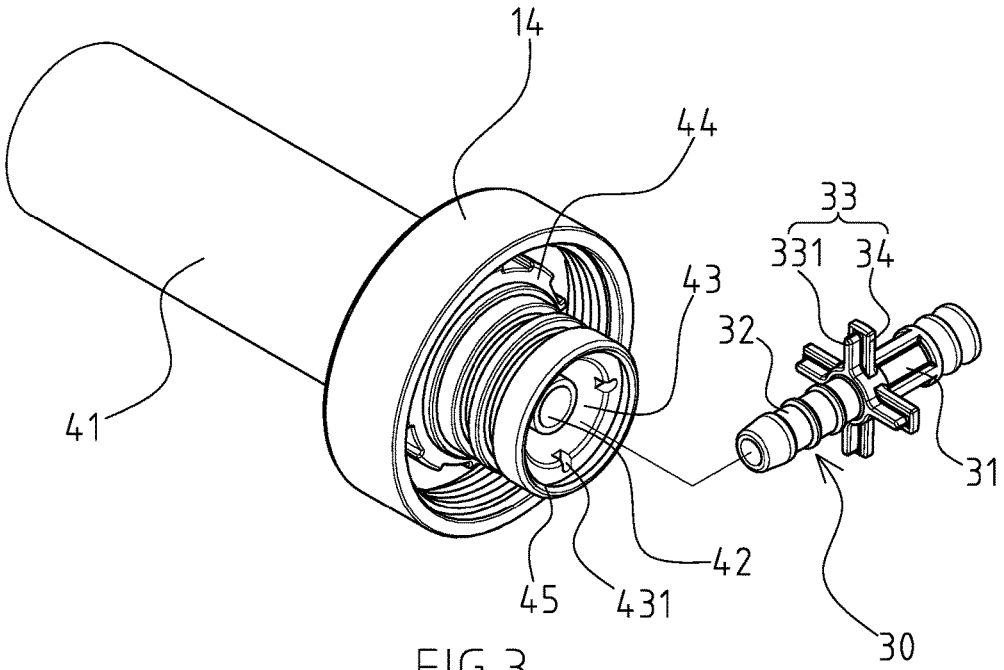
FIG. 3 is a partially exploded perspective view of the faucet in FIG. 1.

In the preferred embodiment of the present invention, the second coupler 43 has multiple indentations 431 defined in a lower end of the outer tube 41 and the first coupler 33 has multiple protrusions 331 extending therefrom, wherein each protrusion 331 is received in a corresponding one of the multiple indentations 431. With reference to FIG. 3, the second coupler 43 is a skirt and the multiple indentations 431 are defined in a distal edge of the second coupler 43. The first coupler 33 has multiple arms 34 radially extending from the connecting structure 30, wherein each protrusion 331 extends from a corresponding one of the multiple arms 34.

The main body 10 includes a recess 12 defined therein and forms with a threaded portion 13, wherein the recess 12 and the threaded portion 13 co-axially correspond to each other. A C-ring 44 is engaged to the lower end of the outer tube 41 and partially received in the recess 12. The main body 10 further includes a union nut 14 having a through hole 141 centrally defined therein to allow the outer tube 41 extending through the union nut 14. The union nut 14 is screwed onto the threaded portion 13 and pressing the C-ring 44 for holding the outlet structure 40 in place.

A ring 45 is formed on the lower end of the outlet tube 41. The ring 45 is engaged to a free end of each of the multiple arms 34 to prevent the first coupler 33 and the second buckle structure 43 from detaching from each other after the first coupler 33 and the second coupler 43 being engaged to each other.

Figure 4:
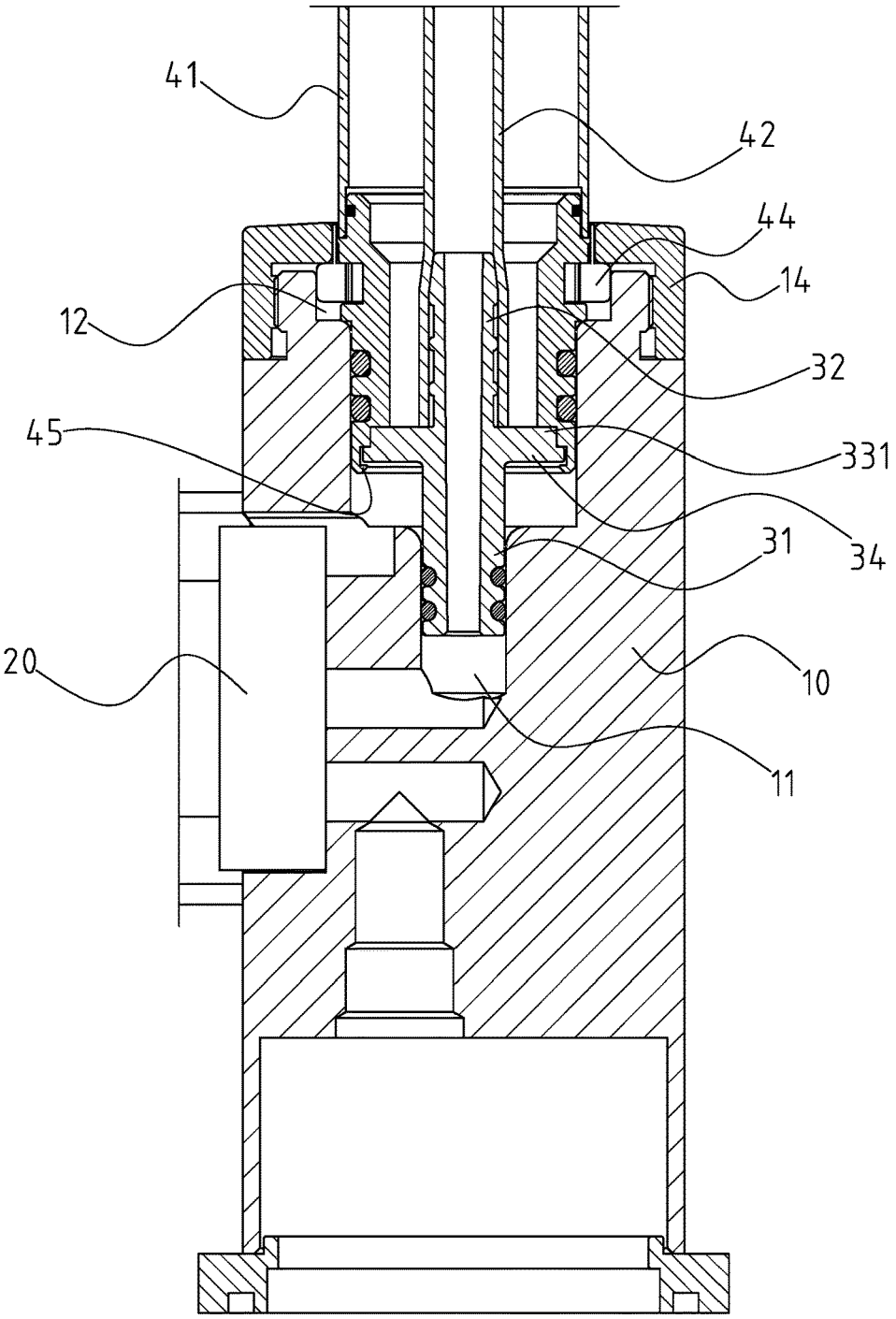
FIG. 4 is a partially cross-sectional view of the faucet in accordance with the present invention.
Figure 5:
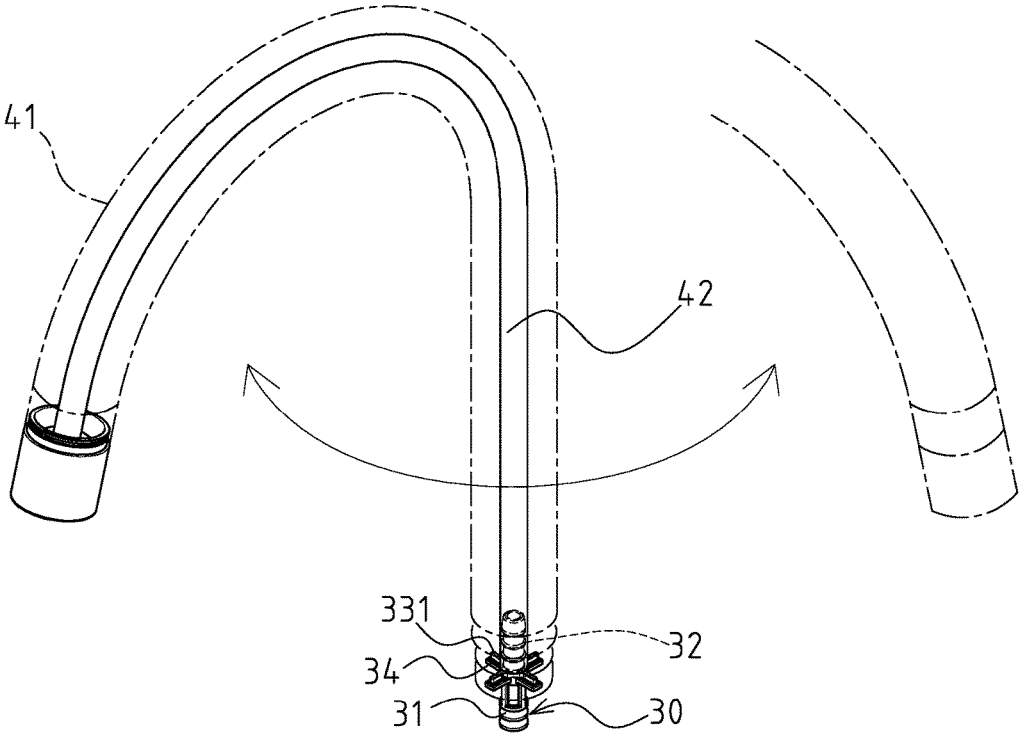
FIG. 5 is an operational view of the outlet structure of the faucet in accordance with the present invention.

With reference to FIGS. 3, 4 and 5, in the preferred embodiment, the faucet is a gooseneck faucet. The first coupler 33 and the second coupler 43 are previously engaged to each other when assembling the faucet, and the inner tube is securely sleeved on the second insertion 32 of the connecting structure 30. Consequently, the inner tube 42 is rotated relative to the main body 10 with the connecting structure 30 when the outer tube 41 is rotated and rotates the connecting structure 30 to make the first insertion 31 being rotated in the outlet flow passage 11. As a result, the connecting structure 30 simultaneously drives the inner tube 42 to be rotated relative to the main body 10 when the outer tube 41 is rotated with the connecting structure 30 such that there in no angular displacement formed between the outer tube 41 and the inner tube 42, and the inner tube 41 does not be twisted when the outer tube 41 is rotated relative to the main body 10.

Figure 6:
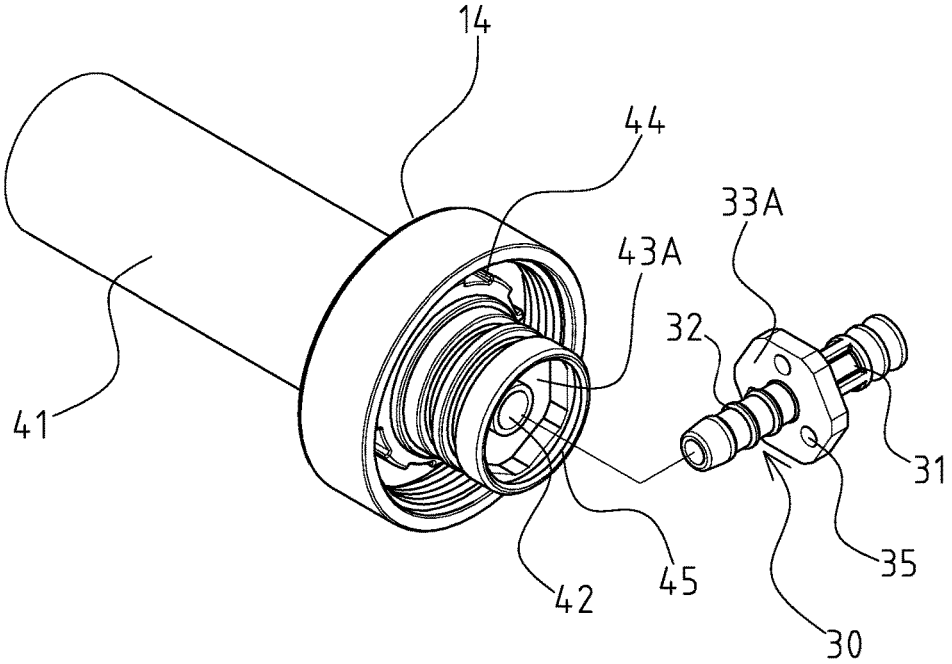
FIG. 6 is a partially exploded perspective view of a second embodiment of the faucet in accordance with the present invention.

With reference to FIG. 6 that shows a second preferred embodiment of the present invention, in this embodiment, the second coupler 43A is a noncircular recess and the first coupler 33A is complementally received in the second coupler 43A. The first coupler 33A has multiple through holes 35 defined therein and communicating with the outer tube 41 to allow the water flowing into the outer tube 41. Accordingly, the first buckle structure 33A also positioned by the buckle 45, described in the first preferred embodiment.

Figure 7:
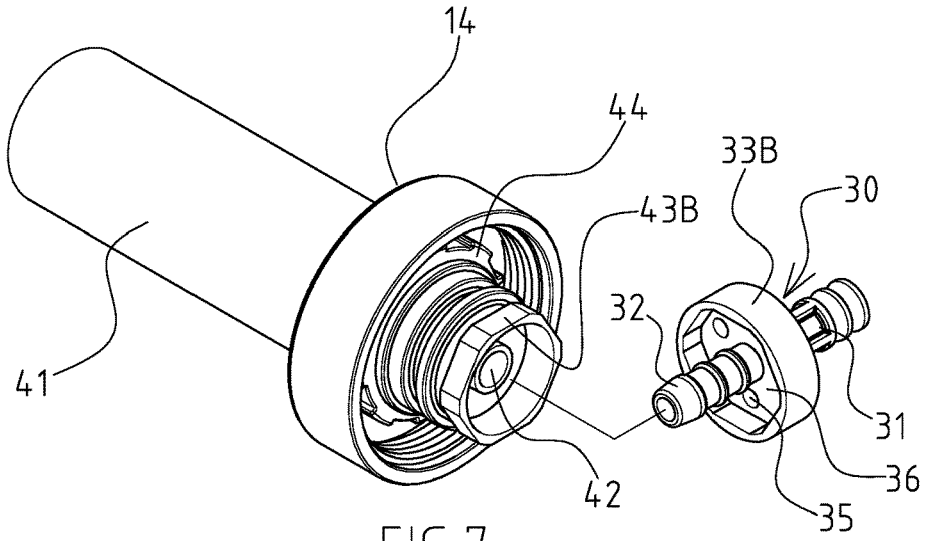
FIG. 7 is a partially exploded perspective view of a third embodiment of the faucet in accordance with the present invention.
Figure 8:
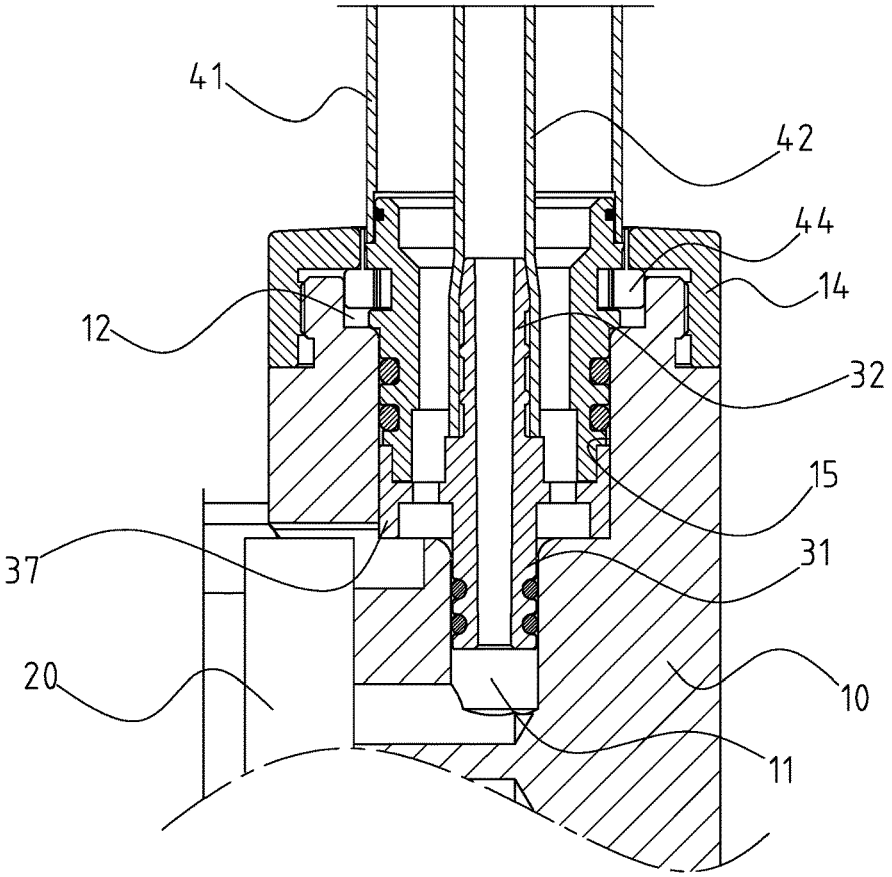
FIG. 8 is a partially cross-sectional view of the third embodiment of the faucet in accordance with the present invention.

With reference to FIGS. 7 and 8 that show a third preferred embodiment of the present invention, in this embodiment, the main body 10 includes a cavity 15 centrally defined in a bottom of the recess 12. The first coupler 33B includes a polygonal recess 36 defined in a first side thereof. The multiple through holes 35, described in the second preferred embodiment, are defined in a bottom of the polygonal recess 36. The second coupler 43B is a polygonal structure that is formed on the lower end of the outer tube 41, wherein the second coupler 43B is complementally received in the polygonal recess 36. The first coupler 33B has a skirt 37 extending from a second side thereof and abutting against a bottom of the cavity 15 to prevent the first coupler 33B from detaching from the second coupler 43B.

Although the invention has been explained in relation to its preferred embodiment, it is to be understood that many other possible modifications and variations can be made without departing from the spirit and scope of the invention as hereinafter claimed.

We claim:

1. A faucet apparatus comprising:

a main body adapted to be mounted on a worktable, said main body having an outlet passage defined therein;

a valve assembly mounted in said main body, said valve assembly adapted to be connected to a water source;

a tubular connecting structure rotatably mounted in said main body and, said tubular connecting structure being divided into a first insertion and a second insertion, said first insertion being water-tightly and rotatably inserted into the outlet flow passage, said tubular connecting structure having a first coupling between the first insertion and the second insertion;

an outlet structure rotatably mounted onto said main body, said outlet structure having an outer tube having a lower end rotatably received in said main body and an inner tube received in the outer tube, wherein the inner tube is flexible and is water-tightly and securely sleeved onto the second insertion, wherein a second coupling is formed on a lower end of the outer tube and engaged with the first coupling such that said tubular connecting structure is not rotatable with respect to the outer tube and the inner tube; and a control lever connected to said valve assembly, said control lever actuating said valve assembly to a position that communicates the outlet flow passage with the water source such that water flows through either the outer tube or the inner tube via said valve assembly, wherein said second coupling has multiple indentations defined in the lower end of the outer tube, the first coupling having multiple protrusions extending therefrom, each of the multiple protrusions being received in a corresponding indentation of the multiple indentations.

2. The faucet apparatus of claim 1, wherein the second coupling is a skirt, the multiple indentations being defined in a distal edge of the second coupling, the first coupling having multiple arms extending radially from said tubular connecting structure, wherein each protrusion of said multiple protrusions extends from a corresponding arm of the multiple arms.

3. The faucet apparatus of claim 1, wherein a ring is formed on the lower end of the outlet tube, the ring being engaged on a free end of the multiple arms so as to prevent the first coupling and the second coupling from detaching from each other.

4. The faucet apparatus of claim 1, wherein said main body has a recess defined therein and a threaded portion formed therewith, the recess and the threaded portion co-axially corresponding with each other, said recess partially receiving a C-ring therein, the C-ring engaged with the lower end of the outer tube.

5. The faucet apparatus of claim 4, wherein said main body has a union nut, the union nut having a through hole centrally defined therein, the outer tube extending through the union nut, said union nut being threadedly secured onto the threaded portion so as to press against the C-ring.

* * * * *